United States Patent [19]

Nijjar

[11] 4,403,628

[45] Sep. 13, 1983

[54] INSIDE BLOWOUT PREVENTER

[75] Inventor: Amrik S. Nijjar, Houston, Tex.

[73] Assignee: Wood George & Company, Houston, Tex.

[21] Appl. No.: 226,726

[22] Filed: Jan. 21, 1981

[51] Int. Cl.[3] ..... F16K 15/02

[52] U.S. Cl. ..... 137/515.5; 137/540; 166/325; 175/318; 251/360

[58] Field of Search ..... 166/321, 322, 325, 327, 166/328; 137/540, 543.21, DIG. 3, 515, 515.3, 515.5, 515.7, 516.29; 251/360, 362; 175/318

[56] References Cited

U.S. PATENT DOCUMENTS

| | | | |
|---|---|---|---|
| 1,545,851 | 7/1925 | Ritter | 166/325 |
| 1,872,139 | 8/1932 | Gray | 137/515.5 X |
| 1,959,043 | 5/1934 | Todd | 137/515.7 |
| 2,063,821 | 12/1936 | McKenzie | 137/515 |
| 2,179,033 | 11/1939 | Cashion | 166/325 |
| 2,213,309 | 9/1940 | Fortune | 137/515.5 X |
| 2,260,381 | 10/1941 | Kennon | 137/DIG. 3 |
| 2,596,832 | 5/1952 | Williams | 175/318 X |
| 3,029,835 | 4/1962 | Biello et al. | 137/540 X |
| 3,537,518 | 11/1970 | Sullivan | 166/325 X |
| 4,270,569 | 6/1981 | Regy et al. | 166/325 |

FOREIGN PATENT DOCUMENTS

| | | | |
|---|---|---|---|
| 356620 | 9/1931 | United Kingdom | 166/325 |

*Primary Examiner*—Robert G. Nilson
*Attorney, Agent, or Firm*—Vaden, Eickenroht, Thompson, Bednar & Jamison

[57] ABSTRACT

An inside blowout preventer including a valve seat pocket and a replaceable valve seat, the valve seat having a lip to bear the longitudinal back pressure in the presence of blowout type pressures from below without causing outward pressure of the pocket seat which cause distortions of the pin end in which the pocket is located.

4 Claims, 1 Drawing Figure

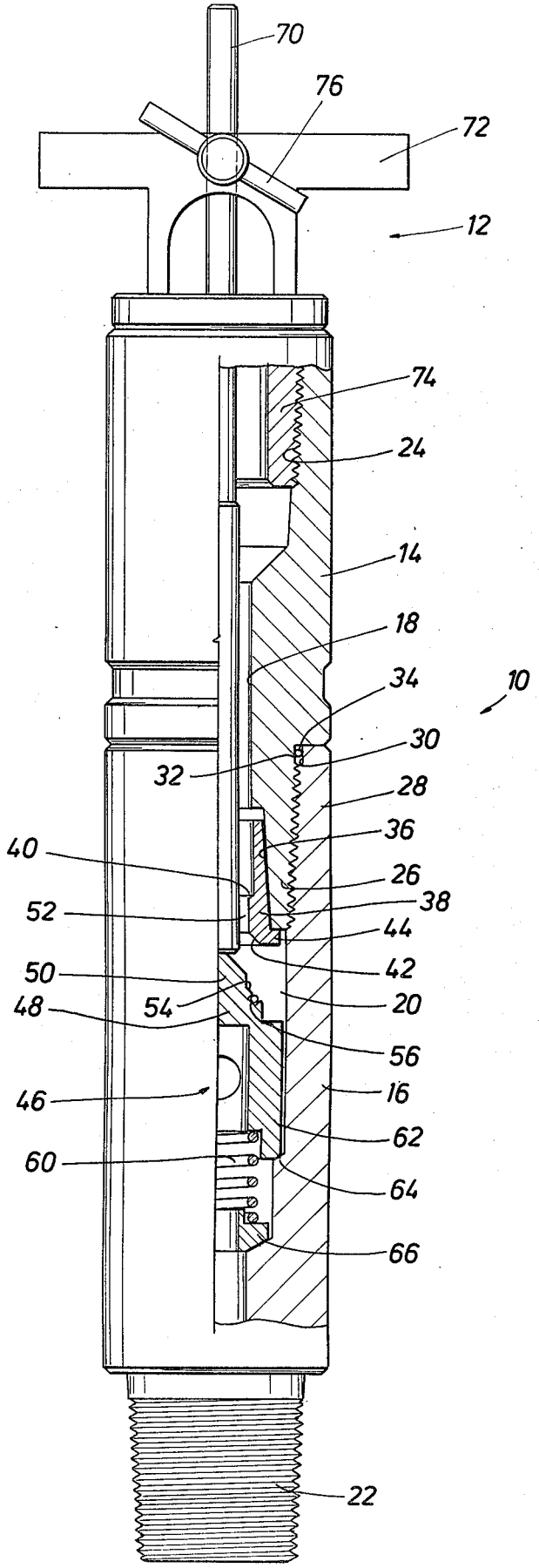
70
76
72
12
74
24
14
18
34
10
30
32
28
36
40
26
38
52
44
42
50
54
20
48
56
46
16
62
60
64
66
22

INSIDE BLOWOUT PREVENTER

BACKGROUND OF THE INVENTION

This invention pertains to drill string tool joints and more particularly to the improvement of such a joint characterized as an inside blowout preventer.

DESCRIPTION OF THE PRIOR ART

Blowout preventers are used in an oil and/or gas well to prevent a rapidly experienced back pressure within the well from blowing parts from the well and causing personal and property damage as a result. Also, if a well is allowed to blow, the spewing of gas and/or oil is a dangerous fire and explosion hazard and is a pollutant to the environment. Further, if a blowout can be prevented, the closing of the well and its subsequent production reopening is relatively inexpensive compared with the closing and reopening expenses of a blown out well.

Blowout preventers take the form of one of two generic structures: an outside blowout preventer and an inside blowout preventer. An outside preventer is usually included in the Christmas tree arrangement or otherwise is part of the assemblage of parts capping off the well installation at the surface of the well. An inside blowout preventer is included in the drill string and includes appropriate valving that closes the string at that point in the presence of excessive back pressure.

It should be noted that back pressures can be extremely high, on the order of 10,000 psi or even more, and that such extreme pressures have been known to damage the blowout preventer components. For example, the valve seat is usually a replaceable part in that it is subject to erosive wear. It is removable by pushing downward. But since it is a separate piece, it can be jammed upward in the presence of extreme pressures from below. Such extreme pressures from below can cause damage to the seat and to the seat pocket, but more importantly, can cause expansion of the pin end in which the seat is located. Such expansion galls the pin threads and results in permanent damage to the more expensive parts of the blowout preventer.

Therefore, it is a feature of the present invention to provide an improvement in an inside blowout preventer employing a replaceable valve seat that is structured in such a way that it does not cause expansion of the pin, even in the presence of extremely high back pressures.

It is another feature of the present invention to provide an improvement in an inside blowout preventer that assures fluid-tight sealing of the parts even though the upper and lower body parts thereof are not firmly tightened together.

SUMMARY OF THE INVENTION

The embodiment of the invention disclosed herein is an inside blowout preventer employing an upper body and a lower body that join together in typical drill stem fashion, i.e., using a pin and box connection. The pin end of the upper body includes a valve seat pocket terminating the center passageway. A separate valve seat fits into the pocket, but is not as long as than the seat pocket is deep to allow a good wedging interference fit.

The lower end of the seat includes a lip, however, that abuts the shoulder of the end of the pin so that even extremely high back pressures do not force the seat so hard against the seat pocket so as to outwardly distort the pin end of the upper body.

The lower body of the blowout preventer includes a dart valve biased in the close position by a spring acting therebelow. Fluid from above opens the valve against the spring and even low formation pressures in the well, but not against high formation pressures.

The pin end of the upper body and the box end of the lower body accommodating the pin end of the upper body include complementary recesses with an O-ring therein to ensure a fluid-tight seal even when the two parts are not completely screwed together as tight by as they should be.

BRIEF DESCRIPTION OF THE DRAWING

So that the manner in which the above-recited features and advantages of the invention, as well as others which will become apparent, are attained and can be understood in detail, more particular description of the invention briefly summarized above may be had by reference to the embodiment thereof which is illustrated in the appended drawing, which drawing forms a part of this specification. It is noted, however, that the appended drawing illustrates only a preferred embodiment of the invention and is therefore not to be considered limiting of its scope, for the invention may admit to other equally effective embodiments.

The FIGURE is a longitudinal cross sectional view of a preferred embodiment of the invention.

DESCRIPTION OF PREFERRED EMBODIMENT

Now referring to the drawing, inside blowout preventer 10 is illustrated with a release tool 12 located in a position of use of such a release tool. When preventer 10 is used in the drill stem, of course release tool 12 is removed. The entire blowout preventer comprises an upper body 14 and a lower body 16, each with a central passage, 18 and 20, respectively, to permit the circulation of fluid therethrough. The upper body and the lower body of the blowout preventer are joined together in a manner explained hereinafter and form an overall joint having a pin end 22 toward the bottom and a box end 24 toward the top of the joint. These ends permit attachment of the inside blowout preventer to other drill string joints in traditional fashion.

Upper body 14 terminates at its lower end in a pin end 26, which includes external threads for tightening into accommodating threads of upper box end 28. In traditional fashion, the external surface of pin end 26 is frustoconically tapered inwardly and downwardly and the internal surface of box end 28 is matingly tapered outwardly and upwardly. The tip end of box 28 is slightly recessed at recess 30, the internal threads of the box not progressing to the end surface. In complementary fashion, pin end 26 is slightly recessed at recess 32 above the threads. An O-ring seal 34 of neoprene or other suitable material is carried in recess 32 so as to achieve a fluid-tight seal between the upper body and the lower body when they are tightened together. In fact, the seal achieves a fluid-tight seal even in the event that the two mating parts are not fully tightened.

The center passage of the upper body terminates at its lower end in a valve seat pocket 36, which tapers downwardly and outwardly in the manner shown. This seat pocket is precision machined into the center passage of the lower end of the upper body to accept a replaceable valve seat 38. Seat 38 is complementarily shaped to snugly upwardly fit in mating relationship with the surface of pocket 36. However, the pocket is sufficiently deep with respect to the length of the seat so that the top shoulder of the seat is separated away from the face of the pocket by a small amount, typically by about one-eighth of an inch. The seat pocket receives the impact of the fluid circulation when in use, and wears away. Therefore, it is expedient that this seat is made to be replaceable.

Seat 38 includes a center passage therethrough that provides an upper shoulder 40 for removal of the seat. The center passage terminates at its lower end in a frustoconically tapered surface 42 for valve operation with an accommodating valve. Seat 38 also includes an outwardly turned lip or flange 44, which inhibits upward excessive wedging movement of seat 38 into the pocket by abutting on the lower shoulder of pin end 26.

Lower body 16 includes a dart valve assembly 46 for operating in conjunction with surface 42 of the valve seat just described. The operating member of the assembly is dart 48, which includes an end portion 50 that extends upwardly into center bore 52 of seat 38 when the valve is closed. Dart 48 also includes a mating surface 54 for sealing against surface 42, surface 54 including an O-ring 56 to ensure securing the seal.

Dart 48 includes a plurality of fins 62, which have openings therethrough to permit the free circulation of fluid, dart 48 being smaller in outside diameter than the expanded center bore inside diameter of lower body 16 in which dart assembly 46 is located.

Dart 48 is biased upwardly by spring 60 located beneath the dart. Fin 62 of dart 48, depending over the outside of a portion of the spring and resting on an internal bore shoulder 64, in cooperation with one or more other fins similarly constructed, limit the lateral movement of the spring. The spring is held in place at the lower end by spring retainer 66.

The entire blowout preventer is assembled into the drill stem and is removed therefrom conveniently only when the valve is locked in the open position. Release tool 12 provides this locking. The tool includes a central rod 70 and a handle unit 72 which has a lower pin end 74 for tightening into box end 24. Once the unit is screwed in, hand crank 76 lowers and locks rod 70 so that it pushes dart 48 against the bias spring and opens the passage. When the blowout preventer is in place, the release tool is removed by reversing the above steps.

Likewise, when it is desired to remove the blowout preventer from the drill stem, the release tool is positioned as described above until the preventer is removed.

In operation of the blowout preventer in a drill string, the bias spring is sufficiently strong to keep the dart valve closed until fluid is circulated. The downward flow of such fluid opens the valve against the bias to permit circulation to occur. A little back pressure because of formation of gas or fluid pressure from below will not prevent the valve from operation. But a dangerous back pressure level will act on the dart with sufficient pressure that a normal amount of pressure from the above will not open the valve and therefore a blowout is prevented.

Extremely high back pressures have been observed, even as great as 10,000 psi or in some cases more. Such pressures have resulted in damage to blowout preventers in the past by forcing the seat upward so hard within the pocket that expansion of the pin results. When the pin expands within the box, the threads on the pin end and even in the box, are galled and virtually weld together, thereby making it virtually impossible to separate the upper body from the lower body. Even if no actual welding occurs, when the threads are jammed together in the manner described, the first time the threads are unscrewed usually badly damages the threads. Also, the seat and the seat pocket are sometimes damaged when the seat is allowed to excessively move upwardly within the accommodating pocket.

Lip 44, however, in the embodiment illustrated, prevents such adverse consequences from happening. The heavy back pressure in the illustrated embodiment is not carried on the tapered and mating walls of the seat pocket and the seat, which pressure has an appreciable outward pressure vector or component. Instead, because of the lesser taper between the dart and the seat than the taper between the seat and the pocket, the pressure between lip 44 and the shoulder of pin end 26 is primarily longitudinal and therefore limits the upward wedging action of seat 38 within pocket 36. Further, there is no consequential expansion of the pin.

While a particular embodiment of the invention has been shown and described, it will be understood that the invention is not limited thereto, since many modifications may be made and will become apparent to those skilled in the art.

What is claimed is:

1. An inside blowout preventer, comprising an upper body having a center passage therethrough, said upper body including an externally lower pin end including a center passage seat pocket with a downwardly and outwardly tapered side surface terminating in a shoulder at its lower end, a lower body having a center passage therethrough, said lower body including an internally threaded upper box end for threaded attachment to said pin end of said upper body, a valve seat having an external side surface upwardly and inwardly tapering so as to mate with said seat pocket, an upwardly biased dart valve having a lesser taper at the valve seating surface than said valve seat surface mating with said seat pocket operating in conjunction with said seat so that normal downwardly circulated fluid through said seat opens said dart valve, excessive backpressure against said dart valve presenting such opening from occurring, said seat having an outwardly turned flange for upward contacting of the shoulder at the terminating end of said seat pocket to prevent excessive back pressure applied to said dart valve from such hard upward wedging of said seat in said seat pocket so as to outwardly distort said pin end.

2. An inside blowout preventer in accordance with claim 1, and including a space between the upper end of said valve seat and said valve seat pocket.

3. An inside blowout preventer in accordance with claim 1, wherein said lower pin end of said upper body includes an external recess, said upper box end of said lower body includes a complementary internal recess, and including an O-ring located within said external and internal recesses.

* * * * *